United States Patent [19]

Himmelbauer

[11] Patent Number: 4,855,638

[45] Date of Patent: Aug. 8, 1989

[54] CAMERA TUBE SYSTEM AND ELECTRON GUN THEREFOR

[75] Inventor: Erich E. Himmelbauer, Eindhoven, Netherlands

[73] Assignee: U.S. Philips Corporation, New York, N.Y.

[21] Appl. No.: 178,161

[22] Filed: Apr. 6, 1988

[30] Foreign Application Priority Data

Apr. 9, 1987 [NL] Netherlands ..... 8700834

[51] Int. Cl.[4] ..... H01J 29/48; H01J 29/62

[52] U.S. Cl. ..... 313/389; 313/452

[58] Field of Search ..... 313/389, 390, 448, 452, 313/458, 382, 414; 315/14, 15

[56] References Cited

U.S. PATENT DOCUMENTS

| | | | |
|---|---|---|---|
| 3,356,880 | 12/1967 | Webster | 313/452 X |
| 3,928,784 | 12/1975 | Weijland | 313/389 |
| 4,376,907 | 3/1983 | Himmelbauer | 313/389 |
| 4,467,243 | 8/1984 | Fukushima et al. | 313/452 X |
| 4,549,113 | 10/1985 | Rao | 313/389 X |

*Primary Examiner*—Donald J. Yusko
*Assistant Examiner*—Sandra L. O'Shea
*Attorney, Agent, or Firm*—Robert J. Kraus

[57] ABSTRACT

A camera tube system having an electron gun of the diode type. The electron gun is provided with an anode consisting of several parts. These parts are provided with apertures, are electrically separated and are adapted to be connected to means to control the potential. As a result of this, it is possible to generate a much larger beam current during the line flyback. This larger beam current makes it possible to avoid the so-called comet-tail effect.

9 Claims, 4 Drawing Sheets

CAMERA TUBE SYSTEM AND ELECTRON GUN THEREFOR

BACKGROUND OF THE INVENTION

The invention relates to a camera tube system comprising an evacuated envelope, a photosensitive target for producing electrical signals corresponding to an optical image formed thereon, a diode electron gun for producing an electron beam, a first means for focussing the electron beam on the photosensitive target and a second means for scanning the photosensitive target with the electron beam. At least the electron gun and the photosensitive target are arranged in the evacuated envelope, the diode electron gun comprising centered along an axis, successively a cathode having an emissive surface, and an anode having a part facing the emissive surface, a central aperture being formed in said part.

A camera tube system of the type described in the opening paragraph is known from U.S. Pat. No. 4,376,907. The target, when scanned with the electron beam, provides electric signals corresponding to the optical image. The photosensitive target often consists of a photoconductive layer which is provided on a signal plate. The formation of the potential distribution, also termed potential image, can readily be understood by considering the photoconductive layer as being composed of a large number of picture elements. Each picture element in turn may be regarded as a capacitor to which a current source is connected in parallel, the current strength of which is proportional to the light intensity on the picture element. When the light intensity is constant, the charge on each capacitor decreases linearly with time. As a result of the scanning, the electron beam periodically passes each picture element and again charges the capacitor. The quantity of charge which is periodically necessary to charge a capacitor is proportional to the light intensity on the respective picture element. The associated charge current flows via the signal resistor which all picture elements have in common. As a result of this, a voltage variation is formed across the signal resistor, which represents, as a function of time, the light intensity of the optical image as a function of place. The resolving power of the image display is determined by the size of the spot which, hence, should be kept as small as possible.

A known problem in camera tube system is the so-called "comet tail" effect. The comet-tail effect occurs when during scanning the beam current is not sufficiently intense to recharge each picture element. This may occur if an image having a very high light intensity is projected on the picture elements of the photosensitive target.

Another aspect of a camera tube system is the response rate. This is the velocity with which the camera tube system reacts to variations of the light intensity. This response rate is influenced inter alia by the fact that the charge which the electron beam supplies to the picture element during the short time in which it passes the picture element depends on the velocity distribution of the electrons in the electron beam. This influencing of the response rate is also termed beam current-lag inertia. The velocity distribution of the electrons depends on the temperature of the cathode and is referred to as Maxwell's distribution. As a result of mutual interactions between the electrons of the electron beam, an excess of fast electrons may be formed. This means that more fast electrons are present in the beam than can be expected according to Maxwell's distribution. This excess of fast electrons adversely affects the beam current-lag inertia and, hence, the response rate.

In an electron gun of the triode type having successively a cathode, a negative grid electrode and a first anode, a beam cross-over is formed because a lens is formed between the cathode and the first anode. Many interactions take place in the cross-over, so that the beam current-lag inertia is adversely influenced. From U.S. Pat. Nos. 3,548,250 and 3,883,773 constructions are known which can prevent the comettail effect in camera tube systems having a triode electron gun. The idea on which these known constructions are based is to form a defocussed electron beam having a relatively large current during the line flyback, the intensity of which beam current suffices to recharge each picture element. To this end, a lens element is present in these known constructions between the first anode and a diaphragm having a central aperture on a second anode. A cross-over is formed during the line scanning, close to the first anode, and the largest part of the beam current is intercepted by the diaphragm on the second anode. Only the central part of the electron beam passes through the aperture in the diaphragm and is subsequently focussed on the target. During the line flyback the voltages applied to the triode and the lens element are changed, such that the electron beam is focussed on the aperture in the diaphragm on the second anode, so that a much larger beam current is available to recharge the picture elements. Then, the electron beam is also out of focus on the target, which is necessary to prevent damage to the photoconductive layer and, hence, a reduction of the life cycle of the camera tube. During the line flyback the cathode is kept at a potential of 5V, such that the photoconductive layer is also stabilized at 5V, i.e. all potential differences on the photoconductive layer exceeding 5V are reduced to 5V. During the line flyback this application requires an electron beam having a relatively large current. A disadvantage of this known construction for counteracting the comet-tail effect is that during scanning the image a large part of the beam current is intercepted by the diaphragm. This is true for application both in a triode gun and in a diode gun. Moreover, this construction is less suitable, in particular, for use in camera tubes having a diode electron gun due to the relatively large beam current which is required during the line flyback, which beam current is generally larger than the beam current available in a diode electron gun.

In the construction of a camera tube system having an electron gun of the diode type, as is known from U.S. Pat. No. 4,376,907, the anode is provided with a central aperture. The intensity of the electron beam is determined by the potential difference and the distance between the cathode and the anode. The beam current can be increased by raising the potential difference. The maximum beam current is limited in that only a small portion of the cathode surface is actually used, a large part of the emitted electrons is intercepted by the anode. Enlarging the central aperture leads to an increase of the maximum beam current, however, it also leads to an enlarged spot and, hence, to a reduction of the resolving power of the image display.

SUMMARY OF THE INVENTION

Therefore, it is an object of the invention to provide a camera tube system having an electron gun of the diode type which can generate an electron beam having a relatively large beam current without reducing the resolving power of the image display.

A camera tube system of the type described in the opening paragraph is characterized according to the invention in that the said part comprises at least two subparts, at least one aperture being formed in each subpart, only the central aperture being formed in one of said subparts, and each subpart being adapted to be connected in operation to means for controlling the voltage of said each subpart.

An important aspect of the invention is that during the line flyback a higher beam current can be obtained because a larger portion of the emissive surface of the cathode surface can be used. The potential differences between the parts of the anode and the cathode are controlled during scanning, such that electrons emitted by the cathode only pass through the central aperture of the central part, in which case an electron beam having a relatively small beam current is obtained which is focussed by the focussing lens so that a small spot is obtained. During the line flyback the potential differences are controlled, such that electrons emitted by the cathode pass through several apertures and, hence, a higher beam current is obtained. The value of the beam current depends upon the size of the surface of the apertures and the potential differences between the parts of the anode and the cathode. During the line flyback the composite electron beam can be imaged out of focus on the signal plate.

Apart from the above-mentioned advantage of a diode electron gun relative to a triode electron gun, a camera tube system according to the invention has also another advantage when compared to camera tubes having a triode electron gun and an anti-comet tail construction as described in U.S. Pat. Nos. 3,548,250 and 3,883,773, namely that the camera tube does not have a lens element between the first and the second anode, which leads to a more readily conceivable construction of the camera tube.

A preferred embodiment is characterized in that the entire surface area of the apertures is at least a number of times larger than the surface area of the central aperture. Thus, it becomes possible to generate a much larger beam current during the line flyback without raising the potentials of parts of the anode to very high values.

A further preferred embodiment is characterized in that the entire surface of the apertures is divided essentially asymmetrically relative to a straight line located in the plane of the anode, which line contains the centre of the central aperture. In the present embodiment, predominantly or only those picture elements which will still be scanned can be stabilized during the line flyback. This leads to a reduced anode current and to a longer life cycle of the picture elements.

Yet another preferred embodiment is characterized in that the anode forms a coherent unit in which the electrically separated parts are interconnected by means of a common electrically insulating carrier. This anode construction has the advantage that the anode forms a coherent mechanical unit, which simplifies the construction of the electron gun. Moreover, a short circuit between the electrically separated parts on the anode is impossible. Problems caused by vibrations of the anode or parts thereof, the so-called microphonics, are reduced.

A further embodiment is characterized in that the coefficients of thermal expansion of the material used for the electrically insulating carrier and of the material or materials used for the electrically separated parts are almost equal. In this way, thermal stresses which may develop in the anode due to differences in the coefficients of thermal expansion can be reduced.

A further embodiment is characterized in that the material used for the electrically insulating carrier has a high coefficient of thermal conductivity. Thermal stresses which may develop in the anode due to differences in temperature can thus be reduced.

BRIEF DESCRIPTION OF THE DRAWING

The invention will now be illustrated in greater detail by means of a few examplary embodiments and with reference to a drawing, in which.

Figure 4:
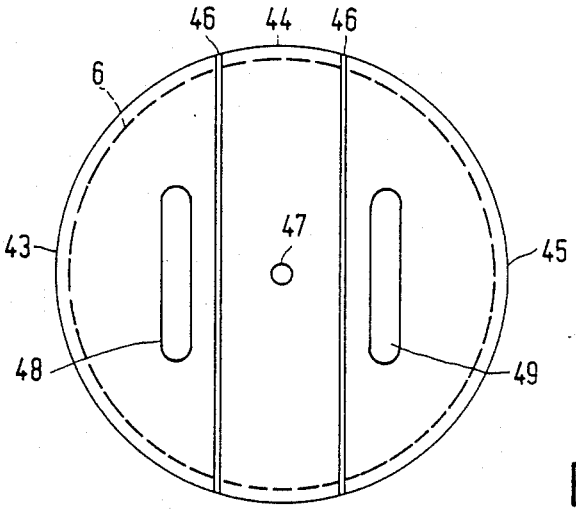
Figure 5:
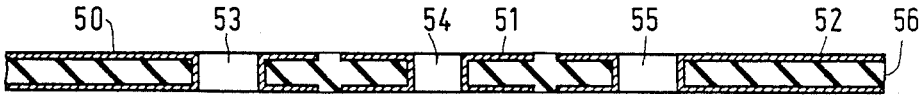
Figure 6:
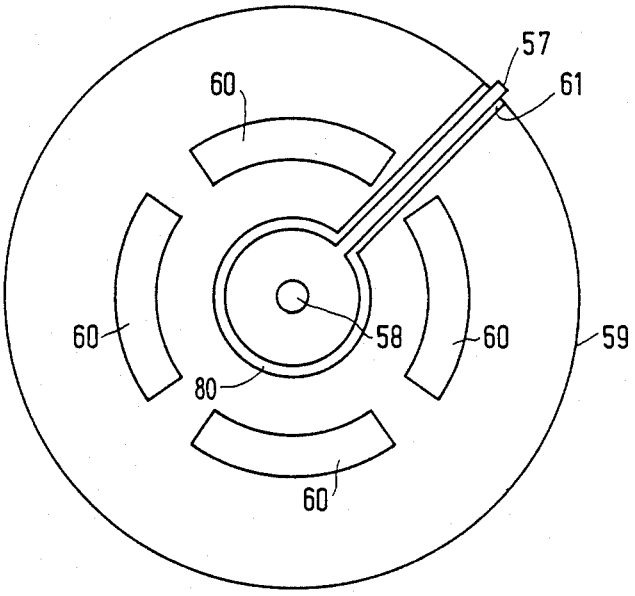
Figure 7:
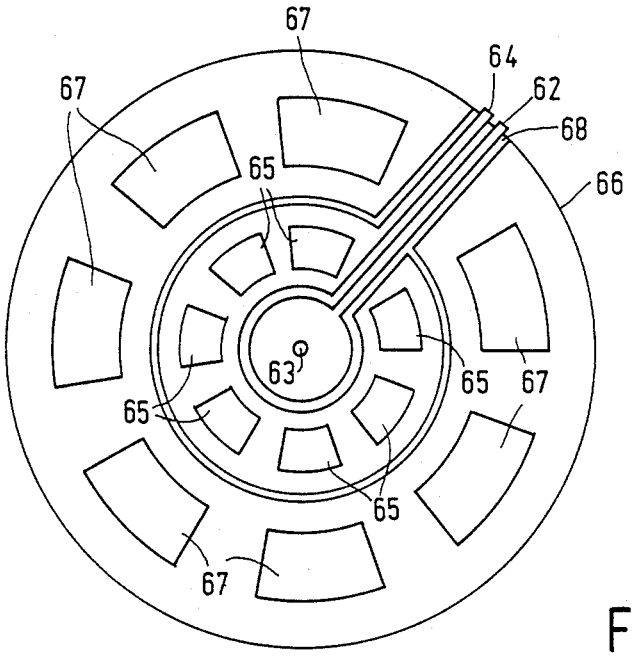
Figure 8:
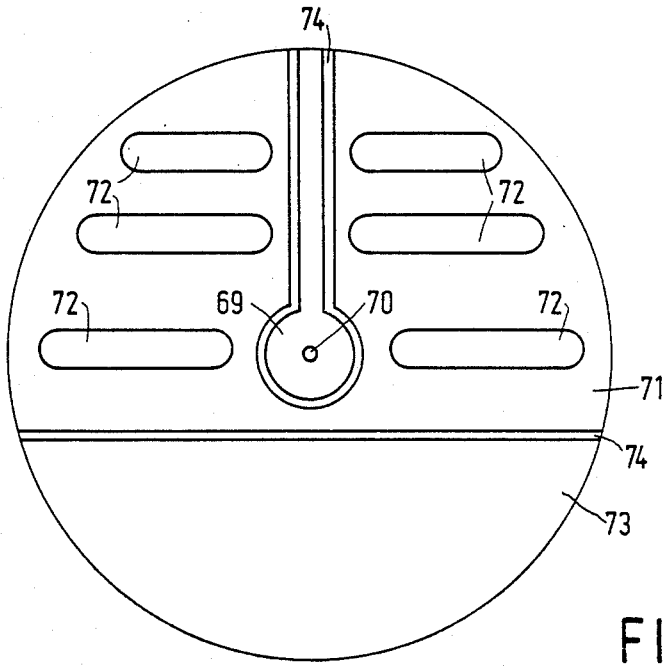

FIG. *3a* is a sectional view of a cathode and an anode of an electron gun which can suitably be used in a camera tube according to the invention;

FIGS. *3b*, *3c* and *3d* are sectional views of a detail of an anode of an electron gun which can suitably be used in a camera tube system according to the invention;

FIG. 4 is a top view of an anode of an electron gun which can suitably be used in a camera tube system system according to the invention;

FIG. 5 is a sectional view of an anode of an electron gun which can suitably be used in a camera tube system according to the invention;

FIGS. 6 and 7 are top views of an anode of an electron gun which can suitably be used in a camera tube system according to the invention; and FIG. 8 is a top view of an anode of an electron gun which can suitably be used in a camera tube system according to the invention, having apertures which are divided essentially asymmetrically.

DESCRIPTION OF THE PREFERRED EMBODIMENTS

Figure 1:
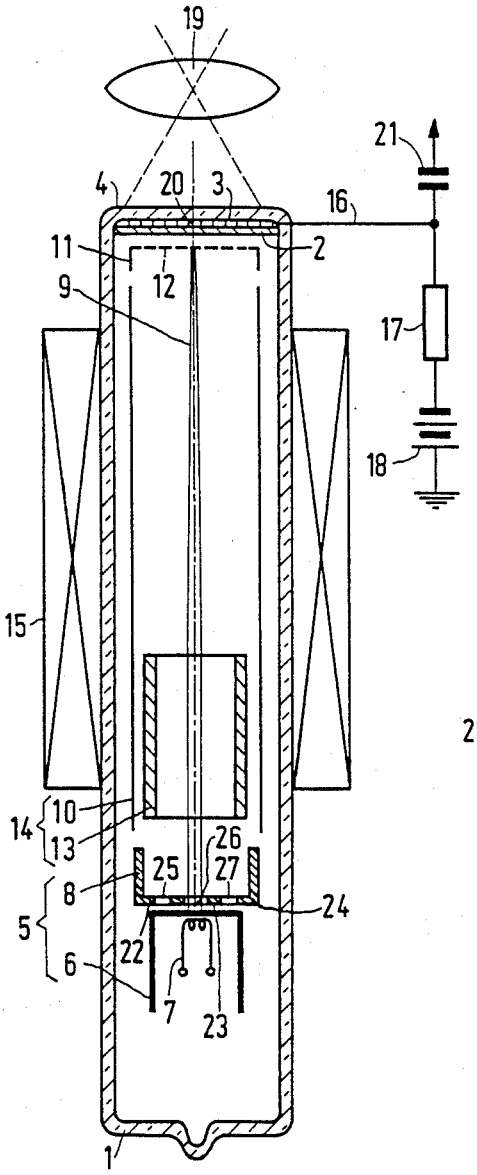
FIG. 1 is a longitudinal sectional view of a camera tube system according to the invention, having an electrostatic focussing lens.

The camera tube shown in a longitudinal sectional view in FIG. 1 has an evacuated cylindrical envelope 1 which consists of glass. The envelope contains a target 2 which consists of a layer of predominantly lead monoxide which is vapour deposited onto a signal plate 3 which consists of a thin properly conducting layer which is provided on the inside of a window 4. Within the envelope 1 there is an electron gun 5 of the diode type comprising a cathode 6, a heating element 7 and an anode 8 which generates an electron beam 9. A second cylindrical anode 10 and an electrically conductive gauze 12 provided on a cylindrical electrode 11 are present between the anode 8 and the target 2. Further, a focussing electrode 13 which, in cooperation with the second cylindrical anode 10, forms a focussing lens 14 is present within the second cylindrical anode 10. The fastening means of the electrodes and various lead wires to the electrodes are not shown in the drawing.

The envelope is partly surrounded by horizontal deflection coils and vertical deflection coils, together referred to as deflection coil system 15. The signal plate 3 is connected to one of the terminal of a voltage source 18, the other terminals being grounded, via a supply line 16 which is led through the envelope and a signal resistor 17.

By means of an optical system which is schematically represented by a lens 19, an optical image to be recorded is imaged through the window 4 and the signal plate 3 on the target 2 of the tube. In this way, a potential distribution, also termed potential image, is formed on the target 2 which corresponds to this optical image. The electron beam is focussed by the lens to form a spot 20 on the target 2. By scanning the electron beam 9, by means of the deflection coil system 15, across the target 2, electric signals which correspond to the optical image are produced. The current involved in this operation flows via the signal resistor 17. As a result of this, a voltage variation is formed across the signal resistor 17 which represents, as a function of time, the light intensity of the optical image as a function of place. This voltage variation is observed via a capacitor 21. The resolving power of the image display is determined by the size of the spot which, hence, should be kept as small as possible.

The anode 8 manufactured according to the invention contains several, in the present drawing three, parts 22, 23 and 24 which have apertures 25, 26 and 27.

Figure 2:
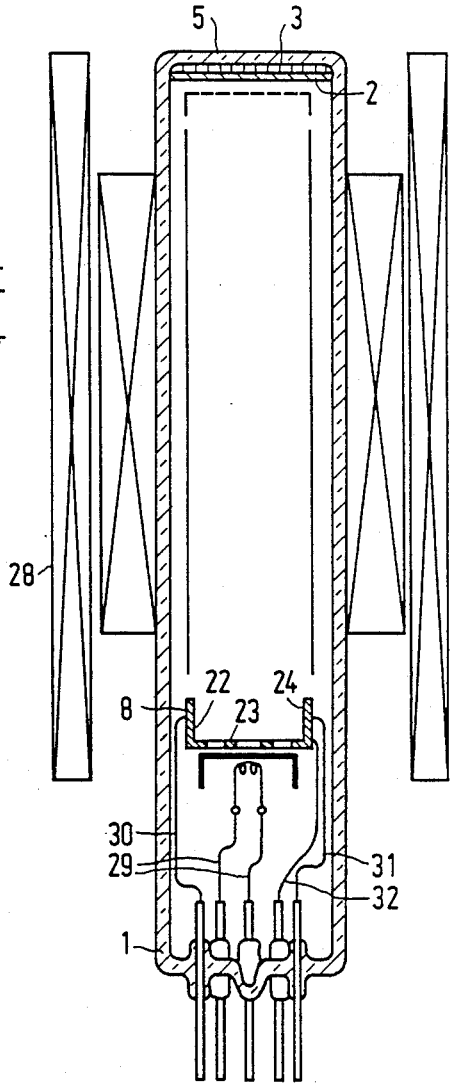
FIG. 2 is a longitudinal sectional view of a camera tube system according to the invention, having an electromagnetic focussing lens.

FIG. 2 is a longitudinal sectional view of a camera tube system having an electromagnetic lens which is represented in this drawing by a coil system 28. This drawing also shows a supply line 29 for the heating element 7 and supply lines 30, 31 and 32 for the parts 22, 23 and 24, respectively, of the anode 8.

Figure 3A:
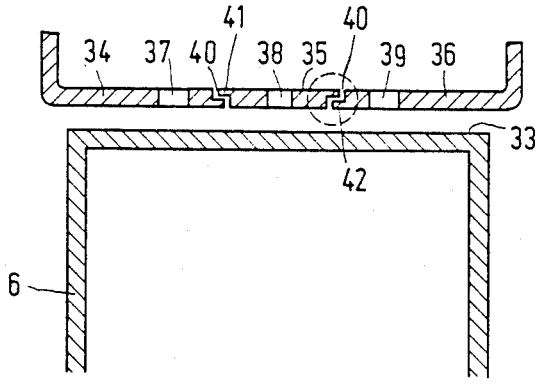

FIG. 3*a* is a sectional, detailed view of an electron gun which can suitably be used for a camera tube system according to the invention. Cathode 6 is provided with an emissive surface 33. The anode located opposite the cathode 6 is divided in several, in the present example three, electrically separated parts 34, 35 and 36 which have apertures 37, 38 and 39. Aperture 38 is located on the axis.

Figure 3B:
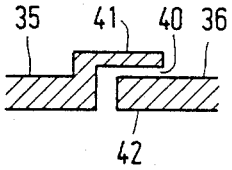
Figure 3C:
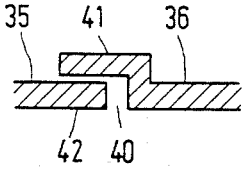
Figure 3D:
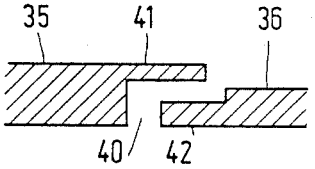

In order to avoid that electrons emitted by the cathode pass through slots 40 between the parts of the anode, said parts are provided with edges 41 and 42 which overlap without contacting one another. Examples of alternative shapes of these edges 41 and 42 are shown in FIGS. 3*b*, 3*c* and 3*d*. The parts 34, 35 and 36 should be prevented from contacting one another, otherwise they would no longer be electrically separated. On designing the anode, and more particularly on chosing the spacing between the parts, which spacing corresponds to the width of the slot 40, thermal effects should be taken into account. The electrically separated parts are also thermally separated and will, hence, generally have a different temperatures higher than room temperature. As a result of this the parts 34, 35 and 36 expand.

During scanning, a positive potential relative to the cathode is given to part 35 and a negative potential relative to the cathode is given to parts 34 and 36. In this situation, the electrons emitted from the surface 33 only pass through the central aperture which then constitutes the object to be imaged electron-optically. The central aperture 38 is imaged on the target 2 (see FIG. 1). Since the parts 34 and 36 have a negative potential relative to the cathode, the portions of the surface 33 facing these parts do not emit electrons. As a result hereof, the anode current, i.e. the electron current intercepted by the anode, is limited.

During the line flyback a positive voltage is applied to all parts of the anode (which voltage may be higher than the voltage during scanning). As a result hereof, a much higher beam current is obtained during the line flyback than in the construction known from U.S. Pat. No. 4,376,907, because a larger portion of the cathode surface is used without the resolving power of the image display being reduced during scanning. During the line flyback the cathode is kept at, for example, 5V so that the photoconductive layer is also stabilized at 5V.

FIG. 4 is a top view of an anode of an electron gun which can suitably be used in a camera tube system according to the invention. In this example, the parts 43, 44 and 45 are constructed as three parallel strips. These parts are electrically separated by slots 46. The part 44 contains the central circular aperture 47. The parts 43 and 45 have elongated apertures 48 and 49. The sum of the surface areas of the apertures 47, 48 and 49 is considerably larger than the surface area of the aperture 47. The diameter of the aperture 47 in FIG. 4 is approximately 60 μm, while the apertures 48 and 49 have a length of 300 μm and a width of 100 μm, so that in the present example the sum of the surface areas of the apertures 47, 48 and 49 is approximately sixty times larger than the surface area of the aperture 47. As a result of this it is possible to generate a much larger beam current during the line flyback without raising the voltages applied to the anode to very high values.

FIG. 5 is a sectional view of a differently shaped anode of an electron gun which can suitably be used in a camera tube system according to the invention. In the present example, the anode consists of the electrically separated parts 50, 51 and 52 which are provided with apertures 53, 54 and 55, and of a common, electrically insulating carrier 56. This construction of the anode has the advantage that thanks to the common carrier 56 the anode forms a coherent mechanical unit, which simplifies the construction of the electron gun. Moreover, a short circuit on the anode between the electrically separated parts 50, 51 and 52 is impossible. Problems caused by vibrations of the anode or parts of the anode, the so-called microphonics, are also reduced. The coefficients of thermal expansion of the material used for the carrier 56 and for the parts 50, 51 and 52 are preferably equal to the extent possible. The material used for the carrier 56 is, preferably, a suitable heat conductor. As a result hereof, thermal stresses in the anode caused by differences in temperature are reduced.

FIG. 6 is a top view of an anode, of the type shown in FIG. 5, of an electron gun which can suitably be used in a camera tube system according to the invention. In the present example, the anode consists of electrically separated parts 57 and 59 having central circular apertures 58 and 80, and apertures 60, which latter apertures are ring segments in the present example, and of an electrically insulating carrier 61. In all Figures the shapes of the apertures are given as examples only. It will be clear that the shapes of the apertures are not limited to the shapes shown herein. The apertures, i.e. the central aperture as well as other apertures, may be, for example, round, oval, square, rectangular or polygonal, and apart from the central aperture they may also have the shape of a ring segment. By constructing the apertures in part 59 as rotationally symmetrical as possible, a substantially rotationally symmetrical spot is formed during the line flyback. The advantage of this construction relative to the anode shown in FIG. 4 is that it comprises only two electrically separated parts and, hence, only two electric supply lines are necessary.

FIG. 7 shows an alternative example of an anode, of the type shown in FIG. 5, of an electron gun which can suitably be used in a camera tube system according to the invention. This anode consists of electrically separated parts 62, 64 and 66 and an electrically insulating carrier 68. The part 62 has the central aperture 63, part 64 is provided with apertures 65 which are in the form of ring segments, part 66 is provided with apertures 67 which are formed as ring segments. Relative to the anode shown in FIG. 6, this construction has the advantage that the maximum beam current is much higher, and that apart from the value of the beam current during the line flyback also the radius of this beam can be controlled.

FIG. 8 shows a further embodiment of an anode of an electron gun for use in a camera tube system according to the invention. This anode consists of the electrically separated parts 69, comprising the central aperture 70, 71, which comprises apertures 72, and 73 which does not have any apertures, and an electrically insulating carrier 74. Due to the shape and the relative position of the apertures 70 and 72 an electron beam is formed during the line flyback, which is essentially asymmetrical relative to the beam formed in the central aperture. The advantage of this embodiment is that is makes it possible, to strike and stabilize at 5V during the line flyback mainly or only picture elements which will still be scanned by the electron beam. Stabilization of picture elements which have already been scanned is of less importance. Thanks to this embodiment, a more efficient use is made during the line flyback of electrons emitted by the cathode, because predominantly or only those picture elements are struck which are still to be scanned. This leads to a smaller anode current and a longer life cycle of the picture elements. The same effect can be attained with an anode of the type shown in FIG. 4 by providing different electric potentials at the parts 43 and 45, so as to form an electron beam which is essentially asymmetrical relative to the central beam, i.e. the electron beam emerging from the central aperture. This makes it necessary to control several electric potentials, leading to a slightly more complex construction.

What is claimed is:

1. A camera tube comprising:

a. an envelope containing a photosensitive target for producing electrical signals corresponding to an optical image formed thereon and a diode electron gun for producing an electron beam;

b. means for focusing the electron beam on the photosensitive target; and c. means for scanning the electron beam across the target;

characterized in that the diode electron gun comprises, arranged along an axis:

(1) a cathode having an electron-emitting surface extending transversely of the axis; and (2) an anode having a portion thereof extending transversely of the axis at a predetermined distance from the cathode surface and facing said surface, said portion including first and second parts which are electrically insulated from each other, the first part having at least one aperture centered on the axis and the second part having at least one aperture disposed radially outward from the first aperture;

a smaller cross-sectional area of the cathode surface substantially emitting electrons when first and second potential differences exist between the cathode and the first and second parts, respectively, and a larger cross-sectional area of the cathode surface substantially emitting electrons when third and fourth potential differences exist between the cathode and the first and second parts, respectively.

2. A camera tube as in claim 1 where a sum of the areas of all of the apertures in the first and second parts is at least several times the area of the at least one aperture in the first part.

3. A camera tube as in claim 2 where the first part has only one aperture.

4. A camera tube as in claim 1 where said electron-emitting surface of the cathode is centered on the axis.

5. A camera tube as in claim 1 where said portion of the anode is centered on the axis.

6. A camera tube as in claim 1 where the second part includes a plurality of apertures which are situated asymmetrically with respect to a plane lying in the axis and bisecting said second part.

7. A camera tube as in claim 1 where the first and second parts are disposed on a single insulating member.

8. A camera tube as in claim 7 where the first and second parts and the insulating member consist essentially of materials having substantially equal coefficients of thermal expansion.

9. A camera tube as in claim 7 or 8 where the material of the insulating member has a high coefficient of thermal conductivity.

* * * * *